US009033262B2

(12) United States Patent
Perez

(10) Patent No.: US 9,033,262 B2
(45) Date of Patent: May 19, 2015

(54) LIQUID DEFLECTION DEVICE

(76) Inventor: Jesus Gonzalez Perez, Chatsworth, CA (US)

( * ) Notice: Subject to any disclaimer, the term of this patent is extended or adjusted under 35 U.S.C. 154(b) by 374 days.

(21) Appl. No.: 13/483,090

(22) Filed: May 30, 2012

(65) Prior Publication Data

US 2013/0320114 A1 Dec. 5, 2013

(51) Int. Cl.
*B05B 1/26* (2006.01)

(52) U.S. Cl.
CPC ..... *B05B 1/262* (2013.01)

(58) Field of Classification Search
CPC ..... B05B 1/26; B05B 1/262; B05B 1/267; B05B 15/001
USPC ..... 239/200–201, 203–206, 223–224, 288, 239/288.5, 505, 513, 521–524
See application file for complete search history.

(56) References Cited

U.S. PATENT DOCUMENTS 682,984 A * 9/1901 Gerdum ..... 239/467
1,364,163 A * 1/1921 Wampler ..... 239/516
2,644,718 A * 7/1953 Richard ..... 239/275
2,778,677 A * 1/1957 Gould et al. ..... 239/513
3,239,149 A * 3/1966 Lindberg, Jr. ..... 239/203
3,880,239 A * 4/1975 Vorkapich ..... 169/37
4,130,247 A * 12/1978 Healy ..... 239/523
6,045,059 A * 4/2000 Weller ..... 239/203
6,702,205 B1 * 3/2004 Abercrombie et al. ..... 239/505
7,066,404 B1 * 6/2006 Kollar ..... 239/288
2004/0021007 A1 * 2/2004 Hakala ..... 239/524
2004/0140375 A1 * 7/2004 Hakala ..... 239/518

* cited by examiner

*Primary Examiner* — Darren W Gorman
(74) *Attorney, Agent, or Firm* — Inventions International Inc.; Tiffany C. Miller

(57) ABSTRACT

A liquid deflection device for the nozzle of an existing spray head wherein the device is rotatably mounted on the nozzle. The device has an attaching end which clips to an existing nozzle. The attaching end is opposite a handle end which a user grasps to rotate the device to block a portion of liquid being released from the exit port of a nozzle. A deflecting end extends beyond the top of the nozzle and has a shape and size sufficient enough to deflect liquid released from the exit port. A securing portion has an opening great enough in diameter to allow a fastener of sufficient size to secure the nozzle. An additional opening on the securing portion allows a user access to a set screw on the nozzle.

8 Claims, 4 Drawing Sheets

LIQUID DEFLECTION DEVICE

BACKGROUND OF THE INVENTION

1. Field of the Invention

This invention relates, generally, to a spray head nozzle attachment. More particularly, it relates to a spray head nozzle attachment that is rotatably mounted to block and deflect a portion of liquid released from the nozzle.

2. Background Art

Water sprinkler manufacturers such as Hunter PGP, Rain Bird, Orbit, Toro, Signature and the like make the spray head nozzles in which a user is able to adjust the water released from the exit port which determines the radius and the arc angle of the water pattern distribution.

Spray head manufacturers also prefer to sell new nozzles with predetermined exit port opening sizes associated with differing water patterns. Therefore, to thoroughly water a yard, a user would need differing nozzles associated with select angles.

Some variable spray head nozzles, such as those manufactured by Rain Bird are adjustable and require a user to ratchet the spray stem and then turn the adjustment ring of the nozzle to adjust the arc angle. However, most companies make a fixed-spray sprinkler head having four patterns of water distribution: 90 degrees; 180 degrees; 270 degrees; and 360 degrees. A user is forced to buy differing nozzles from the manufacturer to accomplish their watering goals. Also, these select models may not accomplish a user's watering goals, resulting in over watering or under watering.

Thus, there is a need for an improved means of adjusting an existing nozzle without having to purchase a plurality of differing nozzles.

Many spray head nozzle manufacturer's design its nozzle with a non-adjustable arc angle.

More particularly, to increase the sales of their own spray heads, spray head manufacturers have added different models of spray heads that adjust the arc angle with the use of a specific manufacturer's tool. Another model of Hunter PGP sprinkler head arc can be adjusted to any angle between 40 degrees and 360 degrees by first taking apart the housing, flipping a latch, and unscrewing a fastener. A user must locate the spray-pattern adjustment screw on the top of the sprinkler head. Then, a user must remove the cap from the top of the sprinkler head. Inserting and turning the plastic key of the Hunter wrench into the adjustment socket turning clockwise or counterclockwise to increase or decrease the arc angle. This adjustment is difficult when determining the desired amount of water needed for a specific area. The steps of inserting and turning the plastic key may need to be performed multiple times before optimum watering results are achieved.

The sprinkler head arc adjustments in conventional spray heads require a user to turn off the sprinkler, disassemble the spray head, rotate the nozzle turret counterclockwise to stop the cycle before the arc can be adjusted, adjust the spray head by: twisting knobs; pressing buttons; using a tool to make adjustments, reassemble the sprinkler to the spray head, and activate the sprinkler to test the arc angle and pattern.

Thus, there is a need for a nozzle attachment that enables a user to adjust the pattern and arc angle of an existing nozzle without a user performing the steps of disassembling the nozzle and manipulating buttons or knobs.

Conventional spray heads further include a set screw that enables the spray head to have an adjustable radius of exiting water. More particularly, depending on the direction that the set screw is turned with a screw driver, the radius respectively increases or decreases.

Thus, there is a need for an improved means of adjusting the radius of existing nozzles. More particularly, when the radius is adjusted, the needed screwdriver would be eliminated.

However, in view of the prior art considered as a whole at the time the present invention was made, it was not obvious to those of ordinary skill in the pertinent art how the identified needs could be fulfilled.

SUMMARY OF THE INVENTION

The long-standing but heretofore unfulfilled need for a liquid deflection device that is adapted to engage a large number of spray head nozzles made by differing spray head manufacturers and which also include improvements that overcome the limitations of prior art liquid deflection devices is now met by a new, useful, and non-obvious invention.

The novel liquid deflection device is adapted to attach to a spray head nozzle. It includes a first contact surface positioned on the upper portion of the nozzle and a second contact surface connected to the first contact surface at the handle end.

The first contact surface and second contact surface are fixedly interconnected to one another and are held against movement relative to one another when fully installed with a fastener onto the upper portion of the nozzle.

The second contact surface has an attaching end sculpted to mate with the nozzle of a plurality of spray head nozzles. Therefore, the novel liquid deflection device fits spray head nozzles made by differing manufacturers and differing nozzle models made by a manufacturer.

The first contact surface forms an upper portion having a handle end opposite a deflecting end. The deflecting end limits the upward movement of liquid released from the nozzle exit port. A second contact surface forms a lower portion having a handle end opposite of an attaching end. The attaching end is configured to attach to a spray head nozzle. Significantly, the novel first contact surface disclosed herein can mate with and deflect the flow of liquid from any spray head nozzle. Thus, it is appropriate to refer to the liquid deflecting portion as the deflecting end.

The deflecting end may be provided in any shape sufficient enough to deflect the flow of liquid released from the nozzle exit port. For example, a "U" shaped deflecting end may deflect and change the radius of liquid being released from the exit port. However, a circle shaped deflecting end could also deflect and change the radius of liquid being released from the exit port. The advantage to having a deflecting end with a radius which closely mates with the top portion of a spray head nozzle is that such a deflecting end maximizes the radius of liquid that may be emitted from the exit port.

Additionally, the deflecting end may be provided in any size sufficient enough to deflect the flow of liquid released from the nozzle exit port.

In a first embodiment, the liquid deflection device is a securing clip which attaches to a nozzle and is rotatably mounted onto the nozzle to block a portion of liquid released from the nozzle exit port, thereby changing the liquid pattern distribution. The securing clip is rotated when a user grasps the securing clip and rotates the securing clip until the securing clip covers a portion of the nozzle exit port. The arc angle of the liquid pattern distribution is adjusted by the rotation of the securing clip.

In a second embodiment, the securing clip attachment has a handle adapted for a user to rotate the attachment around the spray head nozzle. The handle end is adapted for a user to grasp and rotate the first contact surface and the second contact surface around the nozzle. The first contact surface and the second contact surface are disposed in cooperative relation to one another. The first contact surface is adapted to deflect a portion of liquid being released from the exit port. The second contact surface is adapted to block a portion of liquid being released from the exit port.

In a third embodiment, the securing clip attachment has a securing portion that secures the attachment to the top of the nozzle. The securing portion has at least one opening great enough in diameter to allow a user access to a set screw on the nozzle. There may be additional openings great enough in diameter to allow a fastener of sufficient size to secure the nozzle. This securing portion is adapted to be secured to the top of the nozzle with a fastener. The fastener includes, but is not limited to, a screw.

In a fourth embodiment, the attachment has a securing portion with a deflecting end with a shape sufficient enough to block the flow of liquid released from the exit port. Thus, the deflecting end extends beyond the nozzle causing the area above the exit port to be blocked, thereby deflecting the released liquid downward. This deflection of liquid creates a different sized liquid radius emitted from the exit port depending on the location of the securing clip in relation to the nozzle. A user can slide the securing clip forward or backward while attached to the nozzle to adjust the radius size.

These four (4) embodiments are illustrative of the invention and are not exhaustive thereof. As spray head nozzle manufacturers add additional or different features, still further openings may be required in future embodiments of the invention but all such future embodiments are within the scope of this invention.

Moreover, as mentioned earlier, each embodiment of the four (4) illustrative embodiments will attach to and deflect liquid from any spray head nozzle of certain brands and models, regardless of the size of the exit port opening of the nozzle.

For example, the Hunter PGP fixed-spray sprinkler head having a 90 degree pattern of water distribution will accept the securing clip. When the securing clip attaching end is rotated around the nozzle, a portion of the exit port opening will be blocked, and the arc angle will be reduced. When the attachment's deflecting end is extended over the top of the nozzle, the water is deflected.

Thus, the various combination of the liquid deflecting device having an attaching end and a deflecting end will work with all currently known spray head families and sub-families and in view of this disclosure any future changes in spray head nozzle designs can be met.

In addition to the aforesaid embodiments of the securing clip attachment of the liquid deflection device, the liquid deflection device includes multiple additional improvements as well.

A first improvement is a deflecting end which extends above the top portion of a nozzle. The deflecting end is adjusted by a user sliding the securing clip forward or backward to adjust the angle of liquid deflected from the exit port. The liquid is deflected by the deflecting end and results in an adjustable radius of liquid.

A second improvement is an attaching end which is on the lower portion of the securing clip. The attaching end is adjusted by a user sliding the securing clip side to side until a portion of the exit port is covered by the attaching end. The liquid is blocked by the attaching end and results in an adjustable arc angle pattern of liquid distribution.

An important object of this invention is to provide a securing clip that can be used with substantially any commercially available spray head nozzle of certain families.

Another important object is to provide a liquid deflection device with a deflecting end and an attaching end that deflects the liquid released from a nozzle exit port without having to replace an existing nozzle.

Additional objects include the provision of a handle end having improved means of rotating the liquid deflection device, an improved securing portion, and an improved deflecting structure to limit the area of liquid being dispensed, thereby reducing the loss of liquid to unwanted areas.

These and other important objects, advantages, and features of the invention will become clear as this description proceeds.

The invention accordingly comprises the features of construction, combination of elements, and arrangement of parts that will be exemplified in the description set forth hereinafter and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE PREFERRED EMBODIMENT

Figure 1:
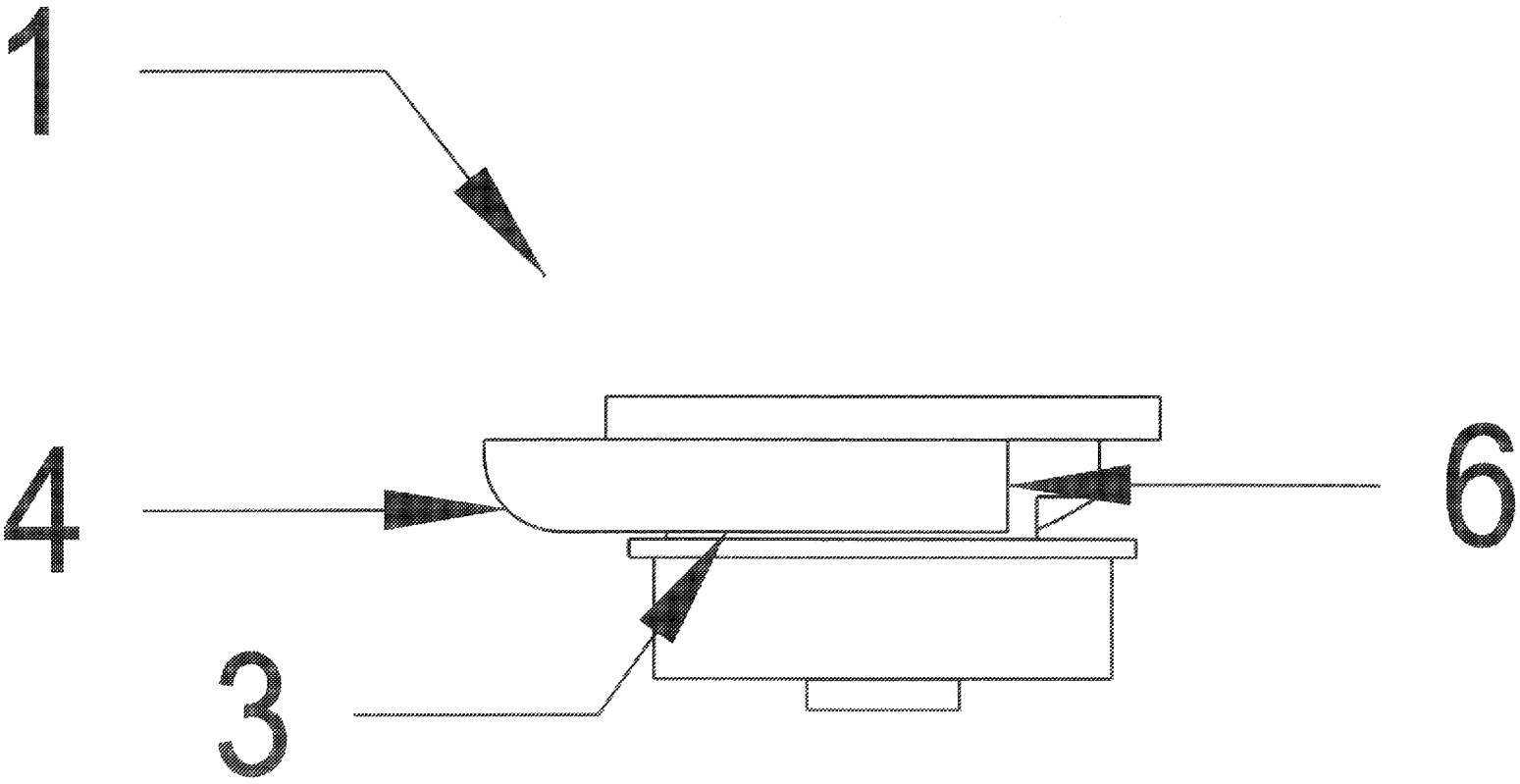
FIG. 1 is a side perspective view of the novel liquid deflecting device securing clip.

Referring now to FIG. 1, it will there be seen that the reference numeral 1 denotes an illustrative embodiment of the novel liquid deflection device securing clip as a whole. Securing clip 3 has an attaching end 6 opposite a handle end 4.

Figure 2:
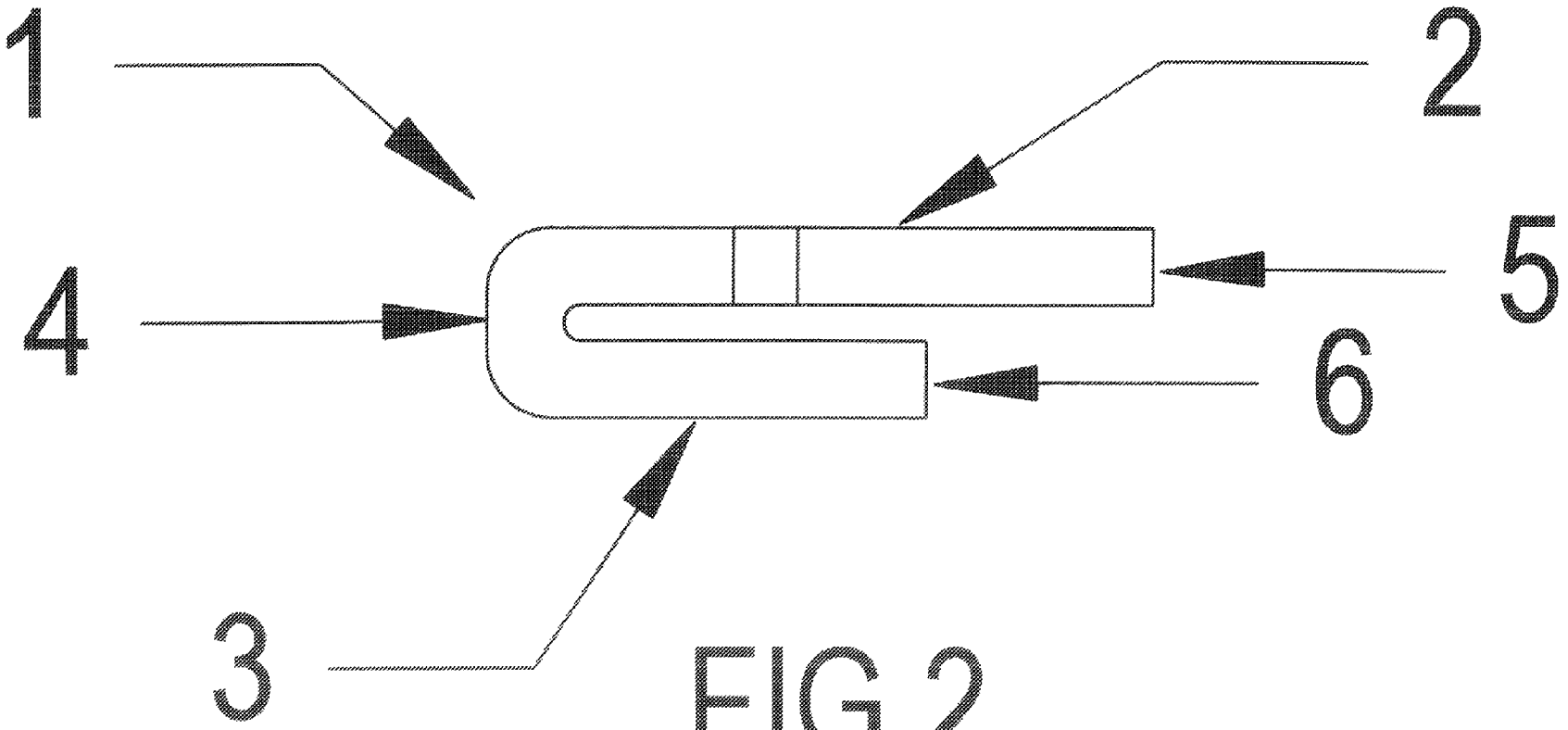
FIG. 2 is a side perspective view of a second embodiment of the novel liquid deflecting device.
Figure 3:
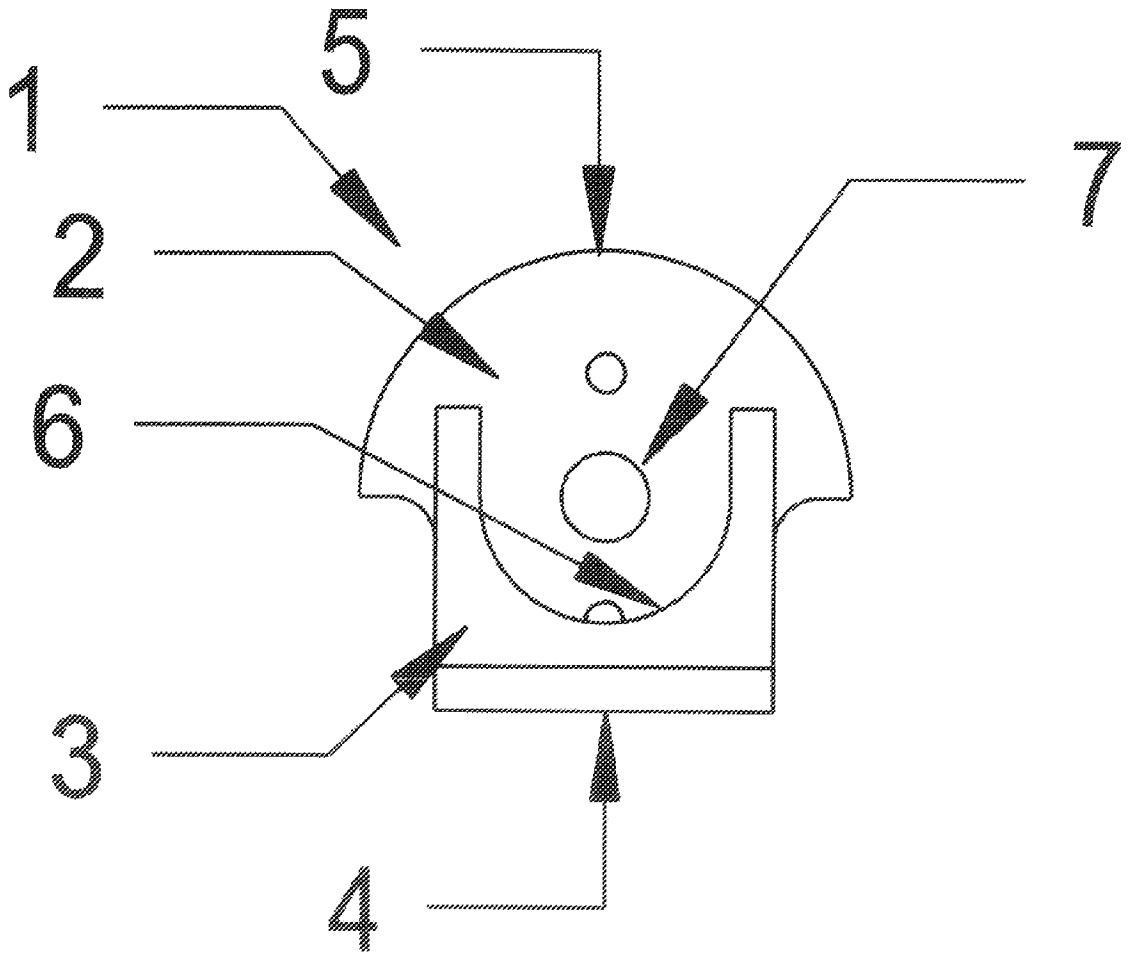
FIG. 3 is a bottom perspective view of the second embodiment of the novel liquid deflecting device.

As best understood in connection with FIGS. 2 and 3, novel liquid deflection device 1 is made by first contact surface 2 connected to second contact surface 3. Second contact surface 3 is a securing clip with attaching end 6 opposite a handle end 4. More particularly, as suggested by the alignment of parts in FIGS. 2-4, first contact surface 2 has a handle end 4 opposite deflecting end 5.

Figure 4:
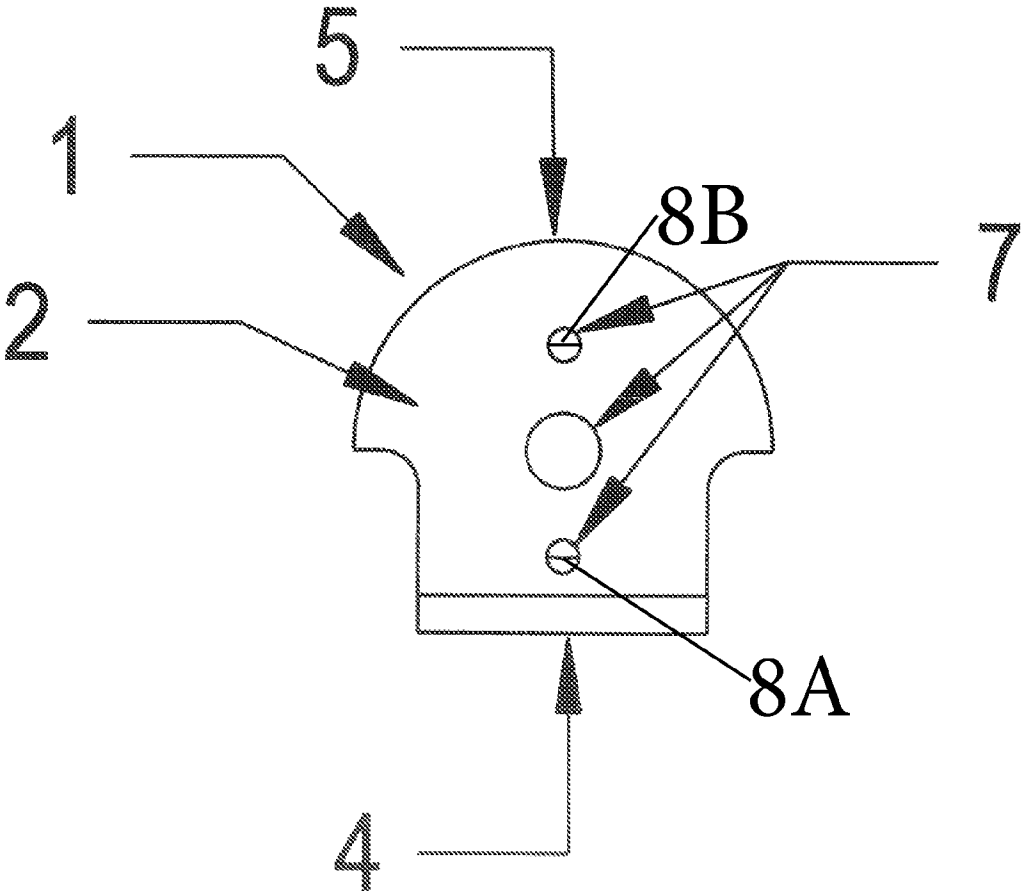
FIG. 4 is a top perspective view of the third embodiment of the novel liquid deflecting device.

In FIGS. 3 and 4, opening 7 is located on the securing portion of first contact surface 2. A plurality of openings 7 allows for access to set screws 8A and 8B.

It will thus be seen that the objects set forth above, and those made apparent from the foregoing description, are efficiently attained. Since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention that, as a matter of language, might be said to fall therebetween.

Now that the invention has been described,

The invention claimed is:

1. A liquid deflection device for a nozzle of a spray head comprising:

a first contact surface forming an upper portion having a handle end opposite a deflecting end, whereby said deflecting end limits upward movement of liquid released from an exit port of said nozzle;

a second contact surface forming a lower portion having said handle end opposite an attaching end, whereby said attaching end is configured to attach to said nozzle;

wherein said attaching end is rotatably mounted around said nozzle to block a portion of the liquid released from said exit port;

wherein said handle end is adapted to rotate said first contact surface and said second contact surface around said nozzle;

whereby said first contact surface and said second contact surface are disposed in cooperative relation to one another and are adapted to block or deflect a portion of liquid that is released from said exit port.

2. The liquid deflection device for a nozzle of a spray head of claim 1, wherein: said first contact surface is adapted to be secured to said nozzle with a fastener.

3. The liquid deflection device for a nozzle of a spray head of claim 2, wherein: said fastener is a screw.

4. The liquid deflection device for a nozzle of a spray head of claim 1, wherein: a portion of said deflecting end extends beyond said nozzle causing the area above said exit port to be covered, thereby deflecting the released liquid downward.

5. The liquid deflection device for a nozzle of a spray head of claim 3, wherein: said deflecting end has a shape sufficient enough to deflect the flow of said liquid released from the exit port.

6. The liquid deflection device for a nozzle of a spray head of claim 1, wherein: said first contact surface has at least one opening.

7. The liquid deflection device for a nozzle of a spray head of claim 6, wherein: said at least one opening is great enough in diameter to allow a user access to a set screw on said nozzle.

8. The liquid deflection device for a nozzle of a spray head of claim 6, wherein: said at least one opening is great enough in diameter to allow a fastener of sufficient size to secure said nozzle.

* * * * *